US008653744B2

(12) United States Patent
Zhang et al.

(10) Patent No.: US 8,653,744 B2
(45) Date of Patent: Feb. 18, 2014

(54) DRIVING CIRCUIT FOR LCD BACKLIGHT SOURCE

(75) Inventors: Liang Zhang, Beijing (CN); Dan Wang, Beijing (CN); Weihai Li, Beijing (CN); Shuai Hou, Beijing (CN); Xingji Wu, Beijing (CN)

(73) Assignees: Boe Technology Group Co., Ltd., Beijing (CN); Beijing Boe Display Technology Co., Ltd., Beijing (CN)

( * ) Notice: Subject to any disclaimer, the term of this patent is extended or adjusted under 35 U.S.C. 154(b) by 50 days.

(21) Appl. No.: 13/433,741

(22) Filed: Mar. 29, 2012

(65) Prior Publication Data

US 2012/0249008 A1 Oct. 4, 2012

(30) Foreign Application Priority Data

Mar. 30, 2011 (CN) ..... 2011 1 0078850

(51) Int. Cl.
*H05B 37/02* (2006.01)

(52) U.S. Cl.
USPC ..... 315/224; 315/207

(58) Field of Classification Search
USPC ..... 315/291, 307, 308, 209 R, 224; 345/211, 212
See application file for complete search history.

(56) References Cited

U.S. PATENT DOCUMENTS

| | | | | |
|---|---|---|---|---|
| 2009/0009104 | A1 | 1/2009 | Doi et al. | |
| 2010/0225290 | A1 * | 9/2010 | Nalbant | 323/282 |
| 2012/0313536 | A1 * | 12/2012 | Kim et al. | 315/186 |
| 2013/0009557 | A1 * | 1/2013 | Szczeszynski | 315/186 |
| 2013/0093355 | A1 * | 4/2013 | Han | 315/294 |
| 2013/0162152 | A1 * | 6/2013 | Lee et al. | 315/192 |

FOREIGN PATENT DOCUMENTS

CN 101111987 A 1/2008

* cited by examiner

*Primary Examiner* — Don Le
(74) *Attorney, Agent, or Firm* — Ladas & Parry LLP

(57) ABSTRACT

A driving circuit for a LCD backlight source comprising a BOOST structure which comprises a capacitor C12, a capacitor C13, an inductor L2, a diode D2, and a MOSFET, wherein the driving circuit further comprises a capacitor C11, a capacitor C14, a diode D3, and a diode D4. One terminal of the diode D3 is connected to one terminal of the capacitor C13, and the other terminal is connected to one terminal of the diode D4; the other terminal of the diode D4 is connected to one terminal of the capacitor C14 which is the output terminal of the circuit, and the other terminal of the capacitor C14 is grounded; one terminal of the capacitor C11 is connected between the inductor L2 and the diode D2, and the other terminal of the capacitor C11 is connected between the diode D3 and the diode D4.

12 Claims, 3 Drawing Sheets

600Khz

DRIVING CIRCUIT FOR LCD BACKLIGHT SOURCE

BACKGROUND

Embodiments of the present disclosure relate to a driving circuit for a liquid crystal display (LCD) backlight source.

A CRT display is a display using a Cathode Ray Tube (CRT). Currently, the flat plate display has taken over the market for the conventional CRT display. In particular, the LCD develops fastest. The LCD is attractive to consumers due to its advantages of light weight, thinness, high resolution, high color Gamut, among others. In the recent years, the concepts of low carbon and environmental protection are increasingly becoming hot topics all over the world. Under this circumstance, different technologies are tried in the display field, represented by the LCD, to obtain the object of low power consumption, low carbon, and environmental protection.

With emission efficiency of the LED increasing, the LED has a very long life time, and it per se does not contain element Hg which is very detrimental to the environment. Due to these advantages, the LED is applied in the field of the LCD backlight source more and more broadly. The LCD product with a LED backlight source attracts lots of users due to its light weight and thinness, and the concept of environmental protection. However, it is the thinness of the LED backlight source that requires the circuit driving the LED backlight source with a special form.

The light weight and thinness mentioned above is realized by an edge-typed placing arrangement of the LED lights. In other words, the LED lights are placed at the edge of the display.

In order to make the backlight source even thinner, it is necessary to reduce the width of the LED column, and in view of the current light package, a metal substrate PCB is required for the design. The metal substrate PCB is a single-side PCB, which means wiring on the single side is required. In order to meet the requirement of both the wiring and the width, the LED lights need to be connected in serial under most of the situations. For the serial connection of multiple lights, the voltage is usually around 60~150V. However, in terms of the current technology for bulk production, normally the input voltage is 24V. As a result, there are two issues: 1). the conversion efficiency at 24V~150V; and 2). the heat dissipation and the price factor of the key devices such as MOSFET in the LED backlight source.

The existing driving circuit for the back light of the LCD of a large size is designed based on the BOOST structure, which is shown in FIG. 1. As shown in FIG. 1, the conventional BOOST structure is illustrated. At this point, the voltage at Vout is larger than or equal to V1, the voltage waveform of which is shown in FIG. 2. As seen from FIG. 2, the voltage tolerance of the MOSFET (Metal-Oxide-Semiconductor Field-Effect Transistor) is around 150V, so a MOSFET with a voltage tolerance of 200V will be chosen. The disadvantages of the circuit are that both the temperature of the circuit board and the Bill OF Material (BOM) of the entire circuit are high, and the current-driving ability of the circuit is low, which means the circuit cannot output a large current, due to devices with a high voltage tolerance such as MOSFET are used.

SUMMARY

Embodiments of the present disclosure is intended to lower the temperature of the circuit board of the driving circuit for the LCD backlight source, reduce the BOM of the circuit, and improve the current-driving ability of the circuit.

An embodiment of the present disclosure provides a driving circuit for a LCD backlight source, comprising a BOOST structure which comprises a capacitor C12, a capacitor C13, an inductor L2, a diode D2, and a MOSFET, wherein the driving circuit further comprises a capacitor C11, a capacitor C14, a diode D3, and a diode D4, wherein one terminal of the diode D3 is connected to one terminal of the capacitor C13, and the other terminal of the diode D3 is connected to one terminal of the diode D4; the other terminal of the diode D4 is connected to one terminal of the capacitor C14 which is the output terminal of the circuit, and the other terminal of the capacitor C14 is grounded; one terminal of the capacitor C11 is connected between the inductor L2 and the diode D2, and the other terminal of the capacitor C11 is connected between the diode D3 and the diode D4.

In an example, all elements in the circuit are made respectively with processes of a voltage tolerance of 100 v.

In an example, one terminal of the capacitor C12 is used as the input terminal of the circuit, which is connected to one terminal of the inductor L2, and the other terminal of the capacitor C12 is grounded.

In an example, the other terminal of the inductor L2 is connected to one terminal of the diode D2 and one terminal of the MOSFET, and another terminal of the MOSFET is grounded.

In an example, the other terminal of the diode D2 is connected to one terminal of the capacitor C13.

In an example, the diode D2, the diode D3, and the diode D4 are all voltage-stabilizing diodes.

In an example, an inductor L3 is connected between the capacitor C13 and the diode D3.

According to the present disclosure, by adding a voltage multiplexer circuit to the existing BOOST structure, a second boost of the voltage is realized such that the driving ability of the circuit is improved. Further, an inductor is added to the voltage multiplexer circuit as a freewheeling inductor to further improve the current-driving ability. In addition, it is possible to use elements (e.g. MOSFET) with a low voltage tolerance in the circuit due to the above design, which is able to lower the temperature of the circuit board, and reduce the BOM of the entire circuit.

Further scope of applicability of the present disclosure will become apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the following detailed description.

BRIEF DESCRIPTION OF THE DRAWINGS

The present disclosure will become more fully understood from the detailed description given hereinafter and the accompanying drawings which are given by way of illustration only, and thus are not limitative of the present disclosure and wherein.

DETAILED DESCRIPTION

A further description of the implementation of the present disclosure is made below in detail, in conjunction with the drawings and the embodiments. The following embodiments are only used to describe the present disclosure, but not used to limit the scope of the present disclosure.

First Embodiment

Figure 3:
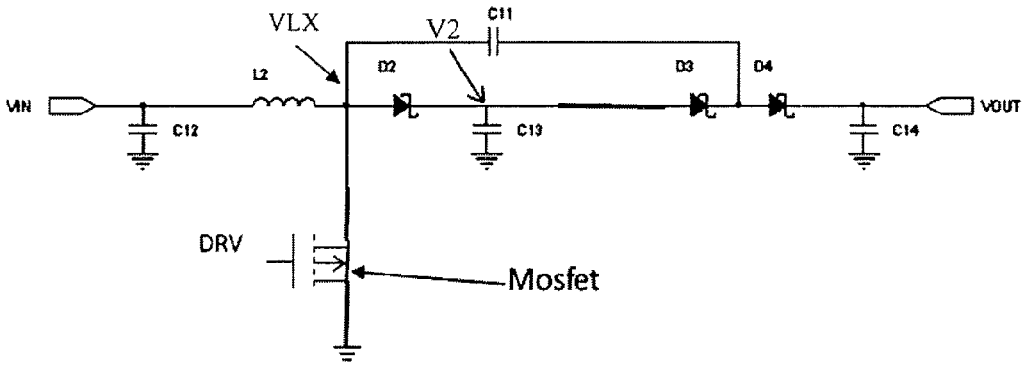
FIG. 3 is a circuit diagram according to the first embodiment of the present disclosure.

The first embodiment of the present disclosure provides a driving circuit for the LCD backlight source, as shown in FIG. 3, comprising a BOOST structure. The BOOST structure comprises a capacitor C12, a capacitor C13, an inductor L2, a diode D2, and a MOSFET which is a single-driven type MOSFET, DRV. The driving circuit also comprises a capacitor C11, a capacitor C14, a diode D3, and a diode D4.

One terminal of the diode D3 is connected to one terminal of the capacitor C13, and the other terminal of the diode D3 is connected to one terminal of the diode D4. The other terminal of the diode D4 is connected to one terminal of the capacitor C14 which is the output terminal of the circuit, and the other terminal of the capacitor C14 is grounded. One terminal of the capacitor C11 is connected between the inductor L2 and the diode D2, and the other terminal of the capacitor C11 is connected between the diode D3 and the diode D4. One terminal of the capacitor C12 is used as the input terminal of the circuit, which is connected to one terminal of the inductor L2, and the other terminal of the capacitor C12 is grounded. The other terminal of the inductor L2 is connected to one terminal of the diode D2 and one terminal of the MOSFET, and another terminal of the MOSFET is grounded. The other terminal of the diode D2 is connected to one terminal of the capacitor C13. The diode D2, the diode D3, and the diode D4 are all voltage-stabilizing diodes.

The voltage at VLX point in FIG. 3 is 75V, therefore, all the devices in the circuit can be made respectively with processes of a voltage tolerance of 100V, which decreases the heat generation in the circuit board.

The above circuit is provided with a voltage multiplexer circuit that comprises C11, D3, D4, and C14 for a second voltage boost, as shown in FIG. 3. The BOOST circuit first boosts the voltage from Vin to V2, and then a charging circuit boosts the voltage from V2 to VOUT. The voltage between D3 and D4 is equal to (VLX−VD2−VD3). VLX charges and discharges C11 repeatedly, making the voltage of C11 and between D3 and D4 changes between VLX and 0 alternately, and the voltage becomes (VLX−VD4) after D4. Therefore, VOUT=(VLX−VD2−VD3)+(VLX−VD4)=2*VLX−VD2−VD3−VD4 through the energy-storing of C14. The total voltage drop of the three diodes D2, D3, and D4 is around 1V, and thus VOUT is provided with (nearly) a second boost compared with VLX. If there is no such second boost, VLX=Vin/(1−D), wherein D is the ON-OFF duty ratio of the MOSFET, while after the second boost, VOUT=2*Vin/(1−D)−VD2−VD3−VD4. It can be seen that the voltage is nearly doubled with the same duty ratio. Therefore, the driving ability for the circuit is improved. However, the driving ability of the circuit is not very high due to the fact that the energy in the voltage multiplexer circuit is only transported by the capacitor C11. A second embodiment below further improves the first embodiment in this respect.

Second Embodiment

Figure 4:
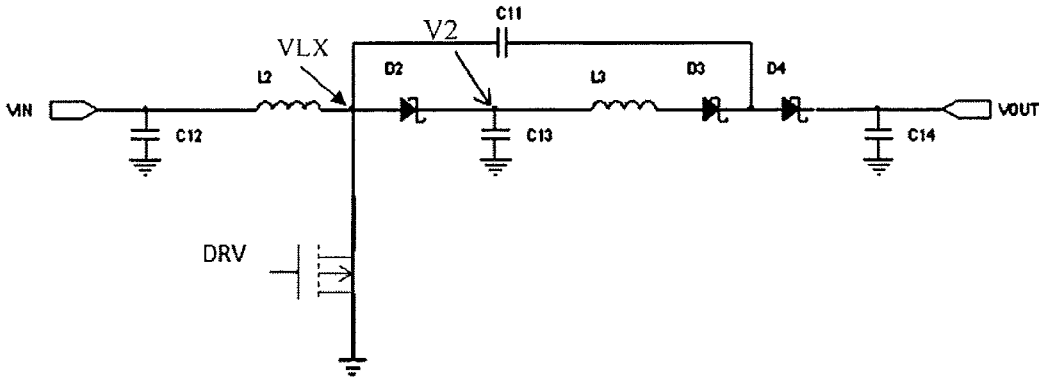
FIG. 4 is a circuit diagram according to the second embodiment of the present disclosure.

As shown in FIG. 4, an inductor L3 between the capacitor C13 and the diode D3 is added to the voltage multiplexer circuit of the second embodiment as a freewheeling inductor, which is able to further improve the current-driving ability of the entire circuit. The inductor L3 keeps the current at both terminals of itself unchanged. When the MOSFET is turned off, the inductor L3 is charged, and when the MOSFET is turned on, L3 is discharged, through its freewheeling. It is possible to improve the current-driving ability of the entire circuit since the current of the inductor L3 supplements for the output current.

Figure 5:
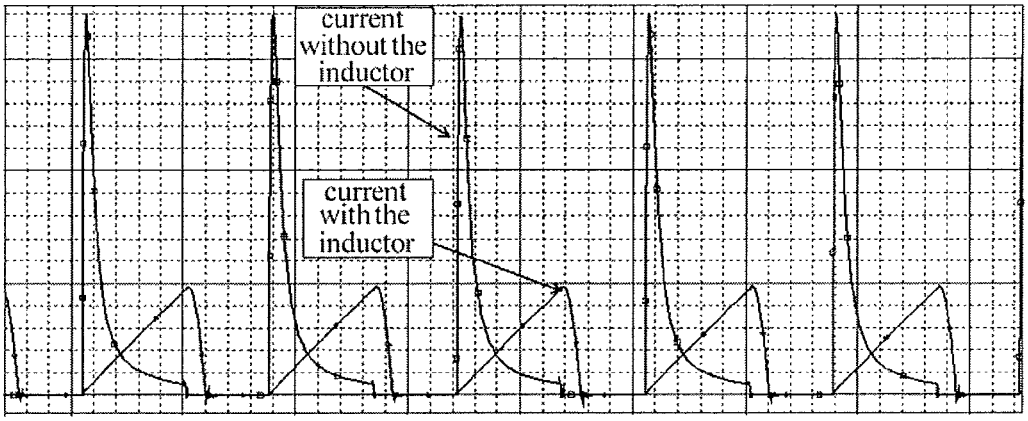
FIG. 5 is a waveform diagram for the charging current of FIG. 4.
Figure 6:
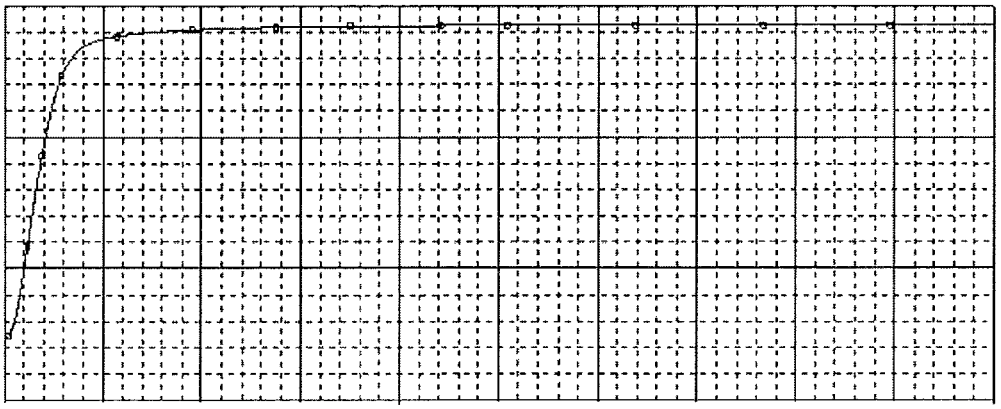
FIG. 6 is a voltage waveform diagram for the point VLX in FIG. 4.

The simulation result shown in FIG. 5 demonstrates that it is possible to improve the charging ability of the entire circuit due to the addition of the inductor L3. The 600 Khz in FIG. 5 is the ON-OFF frequency of the MOSFET. Another simulation experiment is conducted for the second embodiment of the present disclosure, the result of which is shown in FIG. 6. FIG. 6 illustrates a voltage waveform at the point VLX, under the simulation conditions of:

VIN=24V, VOUT=135V, Iout=0.36 A;

L2=22 μH, L3=6.8 μH;

tolerance of the MOSFET being 150V, 3 A;

tolerance of D2 being 150V, 3 A;

C12=10 μf, C14>=10 μf, C11=2.2 μf.

Figure 7:
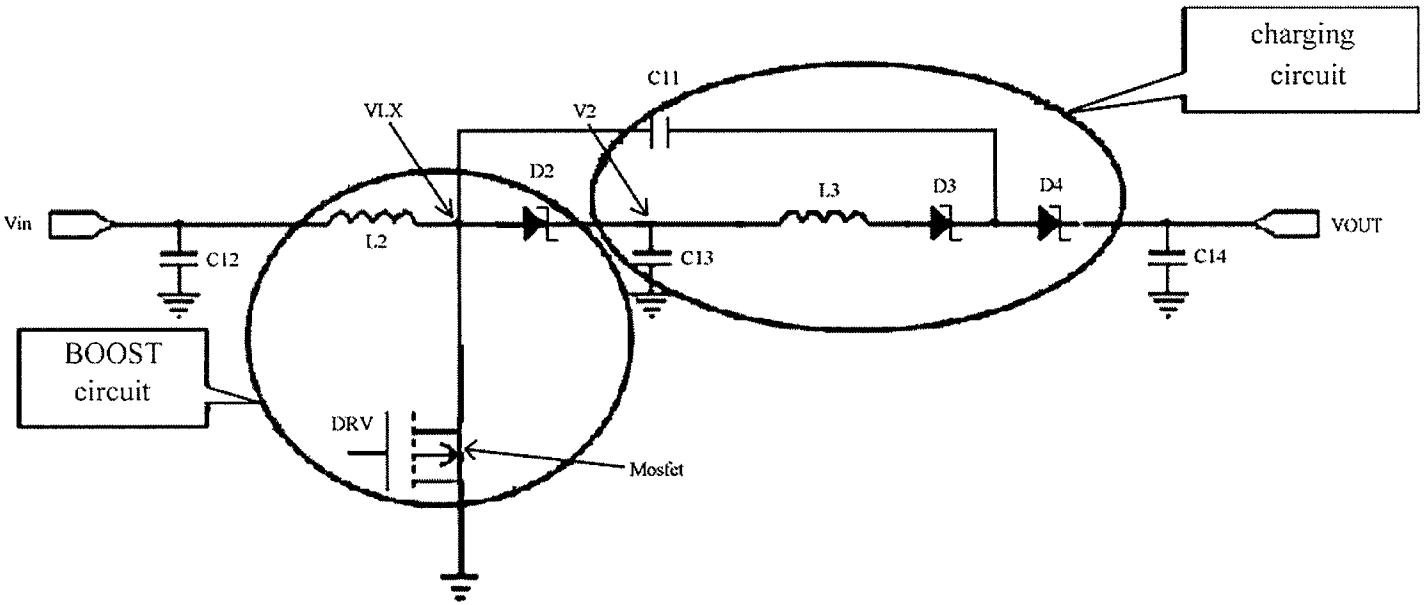
FIG. 7 is the operating principle diagram for FIG. 3 and FIG. 4.

With reference to FIG. 7, when the switch (MOSFET) is turned on, the current is allowed to pass, and V2 charges the storage capacitor C11, and the stored voltage equals V2−VD3, wherein VD3 is the forward turning-on voltage, which is approximately in the range from 0.3V to 0.5V.

Figure 1:
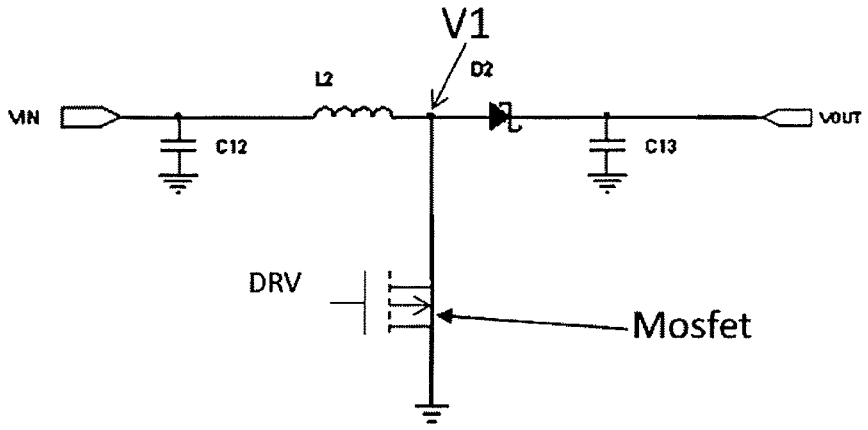
FIG. 1 is a circuit diagram of the existing BOOST structure.
Figure 2:
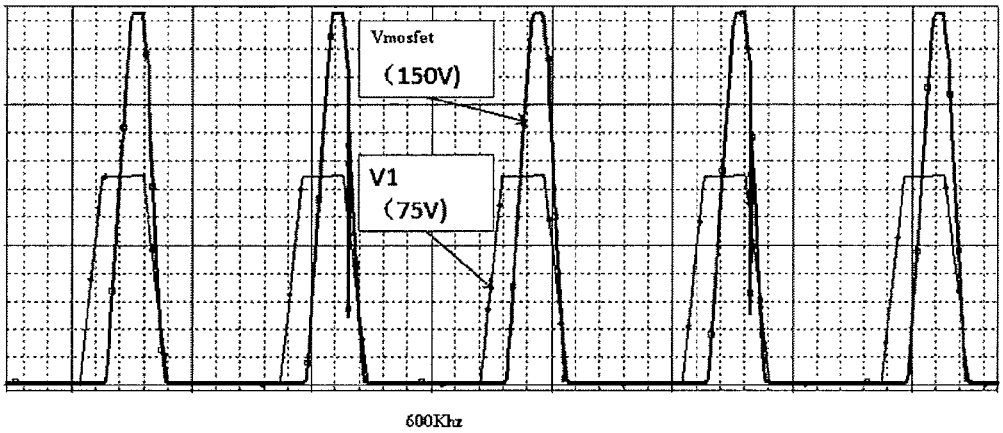
FIG. 2 is a voltage waveform diagram for the point V1 of FIG. 1.

When the switch (MOSFET) is turned off, the voltage at VLX is raised to V2+VD2, and the output voltage VOUT=V2+VD2+V2−VD3−VD4 at this point. If the forward turning-on voltages of the three diodes are the same, the output voltage VOUT=2V2−VD4, wherein VD4 is the forward turning-on voltage of D4. It can be seen that the output voltage VOUT=2VLX−2VD2−VD4 is raised compared with VOUT in FIG. 1, which is smaller than or equal to V1. VD2 and VD4 are the voltage drops across the diodes D2 and D4, respectively, which are approximately in the range from 0.3V to 0.5V.

The MOSFET mainly functions as a switch for the purpose of the energy storage of the inductor. The VOUT is independent of the ON or OFF of the MOSFET. The switch frequency is set as 20 Khz~5 Mhz depending on the peripheral devices and the efficiency.

In the above two embodiments, the output voltage is the same. The only difference is that an inductor L3 is added in the second embodiment for the energy transport purpose, so as to improve the current-driving ability of the circuit.

It is to be noted that the circuit is particularly suitable for a large LCD of over 42 inch.

The above implementations are only for illustration, but not intended to limit the present disclosure. Those skilled in the related art can make various modifications and changes without departing from the spirit and scope of the present disclosure. Therefore, all equivalent technical solutions belong to the scope of the present disclosure, which is defined by the claims.

What is claimed is:

1. A driving circuit for a liquid crystal display (LCD) backlight source, comprising a BOOST structure which comprises a capacitor C12, a capacitor C13, an inductor L2, a diode D2, and a MOSFET, wherein the driving circuit further comprises a capacitor C11, a capacitor C14, a diode D3, and a diode D4, wherein one terminal of the diode D3 is connected to one terminal of the capacitor C13, and the other terminal of the diode D3 is connected to one terminal of the diode D4;

the other terminal of the diode D4 is connected to one terminal of the capacitor C14 which is the output terminal of the circuit, and the other terminal of the capacitor C14 is grounded;

one terminal of the capacitor C11 is connected between the inductor L2 and the diode D2, and the other terminal of the capacitor C11 is connected between the diode D3 and the diode D4.

2. The driving circuit for the LCD backlight source according to claim 1, wherein all elements in the circuit are made respectively with processes of a voltage tolerance of 100 v.

3. The driving circuit for the LCD backlight source according to claim 1, wherein one terminal of the capacitor C12 is used as the input terminal of the circuit, which is connected to one terminal of the inductor L2, and the other terminal of the capacitor C12 is grounded.

4. The driving circuit for the LCD backlight source according to claim 3, wherein the other terminal of the inductor L2 is connected to one terminal of the diode D2 and one terminal of the MOSFET, and another terminal of the MOSFET is grounded.

5. The driving circuit for the LCD backlight source according to claim 4, wherein the other terminal of the diode D2 is connected to one terminal of the capacitor C13.

6. The driving circuit for the LCD backlight source according to claim 1, wherein the diode D2, the diode D3, and the diode D4 are all voltage-stabilizing diodes.

7. The driving circuit for the LCD backlight source according to claim 1, wherein an inductor L3 is connected between the capacitor C13 and the diode D3.

8. The driving circuit for the LCD backlight source according to claim 2, wherein an inductor L3 is connected between the capacitor C13 and the diode D3.

9. The driving circuit for the LCD backlight source according to claim 3, wherein an inductor L3 is connected between the capacitor C13 and the diode D3.

10. The driving circuit for the LCD backlight source according to claim 4, wherein an inductor L3 is connected between the capacitor C13 and the diode D3.

11. The driving circuit for the LCD backlight source according to claim 5, wherein an inductor L3 is connected between the capacitor C13 and the diode D3.

12. The driving circuit for the LCD backlight source according to claim 6, wherein an inductor L3 is connected between the capacitor C13 and the diode D3.

* * * * *